US010446289B2

(12) United States Patent
Henry et al.

(10) Patent No.: US 10,446,289 B2
(45) Date of Patent: Oct. 15, 2019

(54) METHOD OF PROVIDING ELECTRICAL CONDUCTIVITY PROPERTIES IN BIOCOMPOSITE MATERIALS

(71) Applicant: CNH Industrial Canada, Ltd., Saskatoon (CA)

(72) Inventors: James Henry, Saskatoon (CN); Satyanarayan Panigrahi, Saskatoon (CA); Radhey Lal Kushwaha, Saskatoon (CA)

(73) Assignee: CNH Industrial Canada, Ltd., Saskatoon, Saskatchewan (CA)

( * ) Notice: Subject to any disclaimer, the term of this patent is extended or adjusted under 35 U.S.C. 154(b) by 49 days.

(21) Appl. No.: 14/677,638

(22) Filed: Apr. 2, 2015

(65) Prior Publication Data

US 2016/0293287 A1 Oct. 6, 2016

(51) Int. Cl.
*H01B 1/16* (2006.01)
*H01B 1/22* (2006.01)

(52) U.S. Cl.
CPC ..... *H01B 1/16* (2013.01); *H01B 1/22* (2013.01)

(58) Field of Classification Search
CPC ..... H01B 1/16; H01B 1/22
See application file for complete search history.

(56) References Cited

U.S. PATENT DOCUMENTS 3,265,557 A 8/1966 Fries
4,247,596 A 1/1981 Yee
4,375,718 A 3/1983 Wadsworth
(Continued)

FOREIGN PATENT DOCUMENTS

CA 2818658 4/2014
CN 101845753 9/2010
(Continued)

OTHER PUBLICATIONS

Zhang et al., "Self-assembly of single walled carbon nanotubes onto cotton to make conductive yarn", Particuology 10 (2012) 517-521.
(Continued)

*Primary Examiner* — Mark Kopec
*Assistant Examiner* — Jaison P Thomas
(74) *Attorney, Agent, or Firm* — Rebecca L. Henkel; Rickard K. DeMille

(57) ABSTRACT

A method to provide enhanced electrical conductivity to the biocomposite material in which fibrous materials are initially combined and mixed with a polymer base. As the fibrous material and polymer are mixed or compounded, molecular bonds form between the fibrous material and the polymer. At this stage of the process the conductive material and/or particles are added to the mixture because the molecular bonds have formed in the biocomposite material, and the conductive particles cannot interfere with the bonding between the fibrous material and the polymer. The conductive particles are encapsulated by the biocomposite material such that the biocomposite mixture is formed with enhanced electrical conductivity properties, while not detrimentally affecting any of the other enhanced properties of the biocomposite material based on the molecular bonding between the fibrous material and the polymer.

6 Claims, 2 Drawing Sheets

(56) References Cited

U.S. PATENT DOCUMENTS

| | | | | |
|---|---|---|---|---|
| 5,618,858 | A * | 4/1997 | Hauschildt | C08L 23/02 523/200 |
| 80,214,699 | | 9/2008 | Halahmi et al. | |
| 2008/0142762 | A1 | 6/2008 | Ni | |
| 2010/0300618 | A1* | 12/2010 | Frackmann | C08G 18/4202 156/280 |
| 2012/0111404 | A1* | 5/2012 | Hwang | H01B 1/20 136/256 |
| 2014/0093731 | A1 | 4/2014 | Bonfiglio | |
| 2014/0138305 | A1 | 5/2014 | Crandall et al. | |
| 2014/0336309 | A1* | 11/2014 | Sakata | C08L 23/02 524/35 |

FOREIGN PATENT DOCUMENTS

| | | |
|---|---|---|
| KR | 20080108714 | 12/2008 |
| WO | 2014063664 | 5/2014 |
| WO | 14155786 | 10/2014 |

OTHER PUBLICATIONS

Razag et al., Development of Cellulose-Based, Nanbstructured, Conductive Paper for Biomolecular Extraction and Energy Stroage Applications, Digital Comprehensive Summaries of Uppsala Dissertations from the Faculty of Science and Technology 852, 2011, ISSN 1651-6214 0346-5462; ISBN 978-91-554-8150-6.

Bober et al., "Blocomposite of Nanofibrillated Cellulose, Polypyrrole, and Silver nanoparticies with Electroconductive and Antimicrobial Properties", Biomacromolecules 2014, 15, 3655-3663.

He-Zhi et al., "Modification of Sisal Fiber by In Situ Coating Steam Explosion and Electromagnetic Interference Shielding Effectiveness of Sisal Fiber/PP Composites", Polymer Composites, 2014, 6 pages.

Sudar, S. et al., "Thermal characterization and electrical properties of Fe-modified cellulose long fibers and micro crystalline cellulose", J. Therm. Anal. Calorim, 2011, Vo. 104, pp. 841-847.

PCT/IB2015/000725, International Search Report and Written Opinion, dated Dec. 10, 2015, 10 pages.

* cited by examiner

METHOD OF PROVIDING ELECTRICAL CONDUCTIVITY PROPERTIES IN BIOCOMPOSITE MATERIALS

FIELD OF THE INVENTION

The subject matter disclosed herein relates generally to biocomposite materials and, in particular, to a method and system to provide desired electrical conductivity properties to biocomposite materials.

BACKGROUND OF THE INVENTION

Fibrous materials such as straw from flax, sisal, hemp, jute and coir, banana, among others, are used or combined with various polymers in the formation of biocomposite or bio-fiber composite materials. Biocomposite materials utilizing these fibrous materials or fibers mixed with selected polymers provide enhanced desirable properties compared with polymer-only materials. For example, biocomposite materials have the advantageous qualities of light weight, enhanced strength, corrosion resistance, design flexibility, inexpensive production, and environmental friendliness, among others over materials only formed from polymers.

However, regardless of these many beneficial properties, biocomposites normally have a low electrical conductivity as a result of the lack of or limited amount of conductivity of the fibrous materials and polymers used to form the biocomposite material. This lack of conductivity can create certain problems with regard to the end products and/or uses for the biocomposite materials, such as static charge build-ups as well as limiting the applications in which the biocomposite materials can be used.

Certain prior art attempts have been made to overcome these issues and enhance the conductivity of these fibrous materials, thereby increasing the utility of the fibrous materials. Examples of these attempts center on the inclusion of conductive particles on the exterior of the fibrous materials, or on the inclusion of the particles in the structure of the polymer, thereby forming a conductive polymer for subsequent use.

Some examples of the incorporation of these conductive materials as exterior coatings are disclosed in U.S. Pat. No. 4,247,596; US2014/0138305; and US2104/0093731, each of which are expressly incorporated by reference herein in their entirety. In each of these references, a coating is applied to the exterior of a fiber in which the coating includes conductive particles therein.

In these examples, while the fibrous materials including these coatings have increased conductivity due to the presence of the conductive particles in the exterior coating, the location of the conductive particles on the exterior of the fibrous materials can be degraded over time, lessening the effectiveness of the conductivity of the coatings.

Further, in WO2014/155786, a vibration dampening composition is disclosed that includes conductive carbon black particles to assist in the conductivity of a composition having dielectric materials and piezoelectric cellulose fibers in a polymeric material. However, in this disclosure the fibers are directly formed as conductive members, a modification that can detract from the structural and other enhancements to the material in the manner of the fibrous material utilized in biocomposite formulations.

As a result, it is desirable to develop a method for adding or introducing a conductive material into a biocomposite formed with a fibrous material and polymer base that significantly enhances the electrical conductivity of the resulting biocomposite material without detrimentally affecting the other enhanced properties of the biocomposite material when compared with polymer-only materials.

SUMMARY OF THE INVENTION

According to one aspect of an exemplary embodiment of the invention, a method is provided to add a conductive material to a biocomposite material that provides significantly enhanced electrical conductivity to the biocomposite material. In the method, the fibers or fibrous materials are initially combined and mixed with the polymer base. As the fibrous material and polymer are mixed or compounded, molecular bonds form between the fibrous material and the polymer. At this stage of the process the conductive material and/or particles are added to the mixture. When added at this juncture of the biocomposite material processing, because the molecular bonds have for rued in the biocomposite material, the conductive particles cannot interfere with the bonding between the fibrous material and the polymer. Instead, the conductive particles are encapsulated by the biocomposite material as the material formed by the bonded fibrous material and polymer is mixed around the conductive material/particles. In this manner, the biocomposite mixture is formed with enhanced electrical conductivity properties, while also not detrimentally affecting any of the enhanced properties of the biocomposite material not related to the conductive material/particles based on the molecular bonding between the fibrous material and the polymer.

According to another aspect of an exemplary embodiment of the invention, once the conductive particles have been encapsulated by the biocomposite material, the biocomposite material including the conductive material/particles can be into formed into pellets, which can be utilized in various thermoplastic processing technologies, such as extrusion, injection molding, compression molding, rotational molding, among other suitable processes, to create a thermoformed biocomposite product with the enhanced electrical conductivity.

According to another aspect of an exemplary embodiment of the invention, the method requires only the addition of the single step of adding the conductive material/particles near or at the end of the processing/compounding step for forming the biocomposite material in order to provide the enhanced electrical conductivity to the biocomposite material without detrimentally affecting the other properties of the biocomposite.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings furnished herewith illustrates exemplary embodiments of the present invention in which the above advantages and features are clearly disclosed as well as others which will be readily understood from the following description of the illustrated embodiments.

In the drawings.

DETAILED DESCRIPTION OF THE INVENTION

Figure 1:
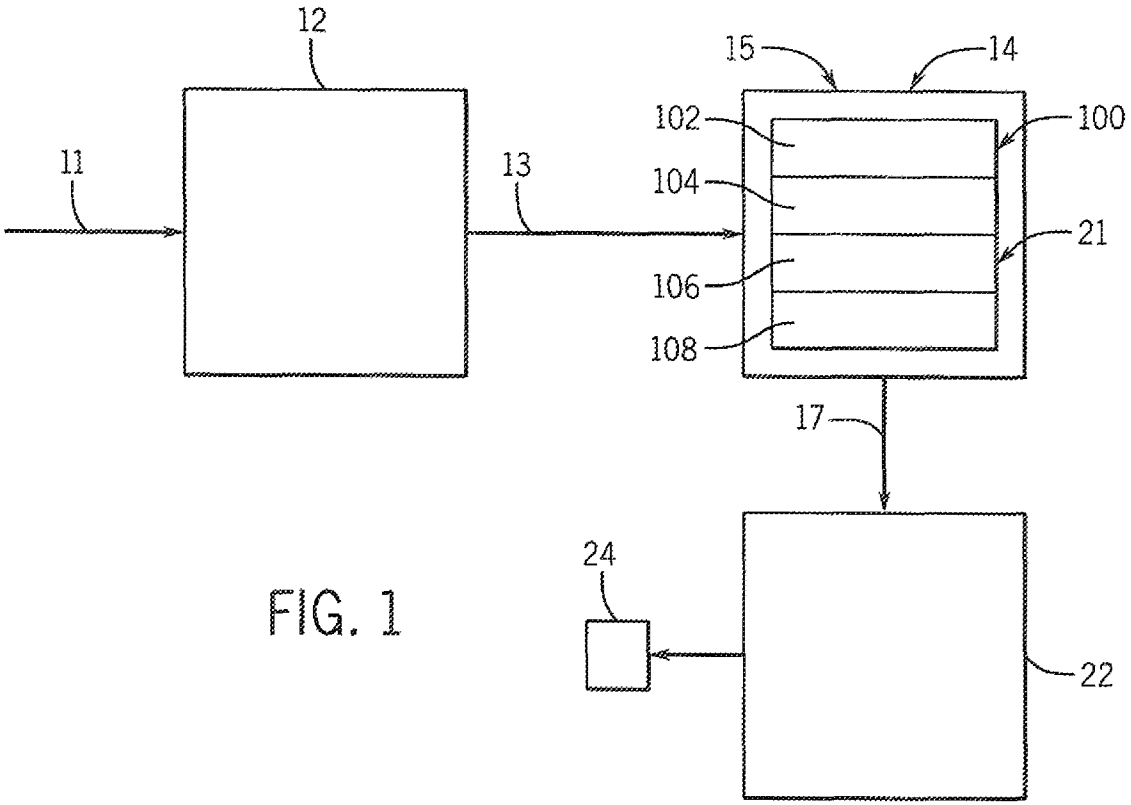
FIG. 1 is a schematic illustration of one exemplary embodiment of a method of forming the biocomposite material according to the present disclosure.

With reference now to the drawing figures in which like reference numerals designate like parts throughout the disclosure, an exemplary embodiment of a method 10 for enhancing the electrical conductivity properties of a biocomposite material formed of combinations of various types of fibrous materials and polymers is illustrated in FIG. 1.

In the illustrated embodiment, the method 10 includes an optional initial step 12 of pretreating the fibrous material 11 for use in the biocomposite. The fibrous material 11 can be selected from any suitable fibrous material used in the formation of biocomposites, and in an exemplary embodiment is a cellulosic based fibrous material such as flax, e.g., oilseed flax or fiber flax, hemp, coir, jute, banana fiber, sugar cane and sisal, among others. The pretreatment step of the fibrous material 11 can be any suitable step for enhancing the properties of the fibrous material 11 for use in form the biocomposite material, such as, for example, by using those pretreating steps disclosed in co-owned and co-pending U.S. patent application Ser. No. 14/087,326, filed on Nov. 22, 2013, the entirety of which is expressly incorporated by reference herein.

After the pretreatment step 12, the fibrous material 13 forming the output of step 12, which in one exemplary embodiment is a cellulose fiber with the hemicellulose and lignin fractions of the source fibrous material removed, is combined in step 14 with a selected and suitable polymer(s) 15 in a suitable processing device to form the biocomposite material 17 output from the processing step 14. Any suitable processing manner can be utilized in step 14, including, but not limited to any extrusion, injection molding, compression molding, rota-molding, lamination, and/or hand layup processes. In addition, the types of polymer(s) 15 capable of being combined with the fibrous material 13 in step 14 include, but are not limited to, suitable thermoplastics and thermoset materials, elastomers, and rubbers.

Figure 2:
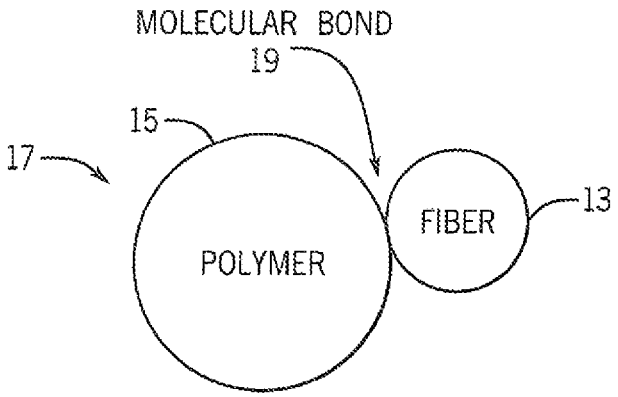
FIG. 2 is a schematic illustration of an exemplary embodiment of a biocomposite material formed according to the present disclosure.

The processing step 14 of the method 10 performs a mixing or compounding of the fibrous material 13 and the polymer(s) 15 in order to enable the fibrous material 13 and the polymer(s) 15 to form molecular bonds 19 between one another, as shown in FIG. 2. The bonds 19 securely engage the fibrous material 13 and the polymer(s) 15 to one another, in order to provide the enhancements of the various properties of the biocomposite material 17 over prior art polymer materials, such as enhanced mechanical strength, light weight, product fast processing method with reduced residence time in the processing step 14, reduced polymer consumption during the processing step 14, reduced power consumption during the processing step 14, improved moisture resistance of the biocomposite 17, and better crystallization of the biocomposite 17.

In the biocomposite formation/compounding step 14, after the molecular bonds 19 have formed between the fibrous material 13 and the polymer 15, i.e., near or at the end of the processing step 14, an amount of a conductive particles/nanoparticles 21 is added to the device or enclosure holding the fibrous material 13 and the polymer 15. In one exemplary embodiment, approximately 0.5-6.0% w/W of a zinc oxide nanoparticle filler with a particle size of less than 100 nm is added to the biocomposite material 17. The conductive particles 21 are added at this point in order to ensure that the conductive particles 21 do not interfere with the formation of the molecular bonds 19, and thus not interfering with the enhanced properties of the resulting biocomposite material 17. In a particular exemplary embodiment, the conductive particles 21 are added to the biocomposite material melt in this step 14 by placing the particles 21 in an extruder 100 in the metering zone 106 upstream from the breaker plate (not shown) which allows the bonds 19 to completely form in the biocomposite material 17 prior to introduction of the particles 21. Overall three zones available in any extruder/compounder 100 which area a) the feeding zone 102; b) the melting zone 104; and c) the metering zone 106. Molecular bonding between the fibers 13 and the polymer 15 takes place in the feeding zone 102 and melting zone 104, such that the conductive material 21 can be added after melting zone 104, such as through the use of another hopper operably connected to the metering zone 106. The residence time of the material 17 and particles 21 in the metering zone 106 depends on screw rpm and l/d ratio of the extruder 100, and can be varied as necessary.

Figure 3:
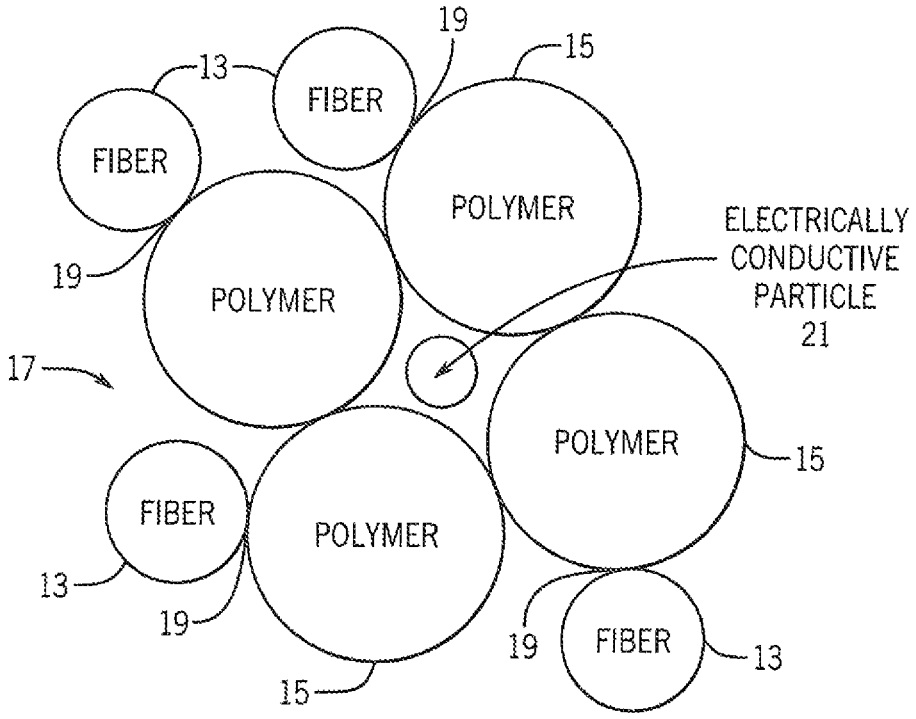
FIG. 3 is a schematic illustration of an exemplary embodiment of an electrical conductivity enhanced biocomposite material formed according to the present disclosure.

With regard to the conductive particles 21, these can be any suitable materials or particles, with certain exemplary materials/particles being selected from one or more of silver, aluminum, copper, iron, zinc, and nickel, among others, along with various conductive oxides and other molecular variations thereof. Once these particles 21 are added to the biocomposite 17, further processing of the biocomposite material melt 17 and the conductive particles 21 enable the conductive particles 21 to become intermixed within the biocomposite material melt 17 as the material 17 and particles 21 move through the metering zone 106 towards the breaker plate 108. More particularly, the biocomposite material melt 17 surrounds and becomes mechanically bonded with the conductive particles 21, as shown in FIG. 3. This mechanical engagement and bonding occurs over the time taken by the material melt 17 and the conductive particles 21 to move through the metering zone 106, such that the time give for three mechanical bonds/engagement to form is approximately one-third of the length of time the fiber 13/polymer 15/material melt 17 is present within the extruder 100.

Once the conductive material 21 is mechanically boned within the biocomposite material 17, the biocomposite material 17 can be formed into pellets (not shown) of the biocomposite material 17 that are output form the processing step 14 and input into a suitable thermoforming process 22 to form an end product 24.

In an alternative embodiment, a conductive material (not shown) can be substituted for the conductive particles 21. The conductive material can have a form and/or size much greater than that of the conductive particles 21, which can further enhance the resulting electrical conductivity of the biocomposite material 17 including the conductive material. However, as the size of the conductive material is larger than the conductive particles 21, the conductive material is added to the biocomposite after the processing step 14, such as in a separate material addition step (not shown) performed between the processing step 14 and the thermoforming step 22 in order to ensure the conductive material does not interfere with the bonds 19 formed in the biocomposite material 17.

In addition, because the illustrated exemplary embodiment of the method of the invention delays the addition of the conductive particles 21 or material until formation of the molecular bonds 19 between the fibrous material 13 and the polymer(s) 15 forming the biocomposite material 17, any damage or other detrimental effects on the physical properties of the resulting biocomposite material 17, such as the enhanced strength properties of biocomposite material 17, are maintained. Further, the presence of the conductive particles 21 or material significantly enhances the electrical conductivity of the biocomposite material 17, such that the material 17 can be utilized to form products 24 for applications where polymers previously could not be used or were impractical based on the low electrical conductivity, such as for electrical signal boosting, or to replace metal components such as in fuel systems, among other uses.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A method for providing electrical conductive properties in a biocomposite material, the method comprising the steps of:

a) mixing a fibrous material and a polymer to form a biocomposite mixture;

b) passing the fibrous material and the polymer through a melting zone to form molecular bonds between the fibrous material and the polymer; and c) mixing an amount of conductive particles with the biocomposite mixture produced by the formation of the molecular bonds between the fibrous material and the polymer and subsequent to the biocomposite mixture passing into a metering zone downstream from the melting zone wherein the conductive particles are encapsulated within the biocomposite mixture in part by the molecular bonds formed between the fibrous material and the polymer.

2. The method of claim 1 wherein the conductive particles are conductive nanoparticles.

3. The method of claim 1 wherein the conductive particles are selected from the group consisting of silver, aluminum, zinc, copper, iron, nickel and combinations thereof.

4. The method of claim 1 wherein the step of mixing the conductive particles with the biocomposite mixture comprises adding the conductive particles directly to the biocomposite mixture as it is being mixed.

5. A biocomposite formed with electrically conductive properties by the method of claim 1.

6. A product formed from a biocomposite formed by the method of claim 1.

* * * * *